United States Patent [19]

Nagata

[11] 4,389,006

[45] Jun. 21, 1983

[54] STRUCTURE FOR SECURING A BAND TO A WATCHCASE

[75] Inventor: Hiromichi Nagata, Tanashi, Japan

[73] Assignee: Citizen Watch Co., Ltd., Tokyo, Japan

[21] Appl. No.: 308,832

[22] Filed: Oct. 5, 1981

[30] Foreign Application Priority Data

Oct. 7, 1980 [JP] Japan ..... 55-142282[U]

[51] Int. Cl.[3] ..... A44C 5/14

[52] U.S. Cl. ..... 224/164; 63/21; 403/409

[58] Field of Search ..... 224/164–179; 63/7–9, 21, 22, 29 R; 403/409, 161, 162

[56] References Cited

FOREIGN PATENT DOCUMENTS

| | | | |
|---|---|---|---|
| 2733094 | 2/1979 | Fed. Rep. of Germany | 224/164 |
| 1086037 | 2/1955 | France | 224/179 |
| 1227714 | 8/1960 | France | 63/9 |
| 48-108662 | of 1973 | Japan . | |
| 38604 | 5/1907 | Switzerland | 224/164 |
| 61500 | 6/1912 | Switzerland | 224/170 |
| 347490 | 8/1960 | Switzerland | 224/164 |
| 579302 | 8/1976 | Switzerland | 224/164 |

*Primary Examiner*—William Price
*Assistant Examiner*—Gary E. Elkins
*Attorney, Agent, or Firm*—Stern & Roberts

[57] ABSTRACT

Structure for securing a band to a watch case which has a pair of legs and a cover between the legs at a band-connected side thereof. A connecting member having an L-shaped cross section is secured to an end of the band. A threaded hole is provided in each leg and a screw having a taper end is screwed in the threaded hole. The taper end is engaged with the connecting member, so that the connecting member is pressed against the side wall of the watch case.

5 Claims, 4 Drawing Figures

STRUCTURE FOR SECURING A BAND TO A WATCHCASE

BACKGROUND OF THE INVENTION

The present invention relates to a structure for securing a band to a watch case.

Generally, the watch band is connected to the watch case by a bar having a pair of spring loaded end pins. Recently, a wristwatch tends to be so thinner that it is difficult to use such a bar for securing the band.

On the other hand, it is desirable that the end of the watch band is closely attached to the side wall of the watch case without a gap. In order to solve these problems, for example, a securing structure using taper screws described in the Japanese Utility Model Application Laid Open No. 48-108662 is proposed.

In such a securing structure, a pair of threaded holes for taper screws must be provided in an end portion of the band. Therefore, the securing structure has disadvantages as follows.

(1) Thickness of an engaging portion of the case is over 2 mm at the least, if the bore of the threaded hole is decreased to 1 mm, and the thickness becomes 3 mm, if a cover is provided over the engaging portion.

(2) Since a hole can not be bored in a band composed by thin plates or wires, such as a mesh or helical type band, a separated member is necessary to interconnect the band and the watch case. Therefore, design of the band is limited to a small range by such a connecting structure.

SUMMARY OF THE INVENTION

An object of the present invention is to provide a securing structure of a band to a watch case which may be made in thinner structure.

Another object of the present invention is to provide a structure in which the watch case and band are contacted without gap.

According to the present invention, there is provided a structure for securing a band to a watch case having a pair of legs and a cover between the legs at a band-connected side, comprising a connecting member secured to an end portion of said band, said connecting member comprising a horizontal plate extending from the end of said band and a vertical plate downwardly extending from the extended end of said horizontal plate, threaded holes provided in said legs, a screw engaged in each of said threaded holes, said screw having a taper end portion which is engaged with said connecting member, whereby said connecting member is pressed against the side wall of said watch case.

These and other objects and features of the present invention will become more apparent from the following description with reference to the accompanying drawings.

DESCRIPTION OF THE PREFERRED EMBODIMENTS

It will be noted that although one side of a watch case is illustrated, the other side is the same structure as the illustrated structure.

Figure 1:
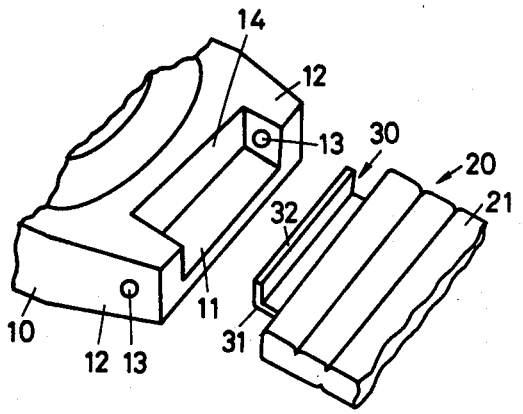
FIG. 1 is a perspective view showing a part of a watch case and a band to be connected with each other according to the present invention, as viewed from the underside thereof.
Figure 2:
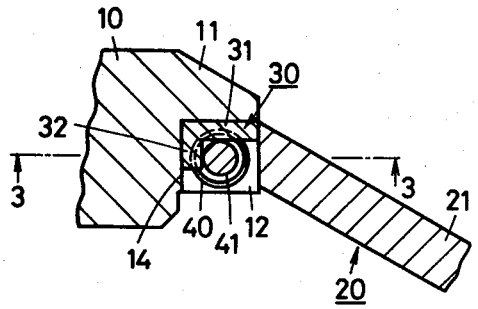
FIG. 2 is a sectional view taken on the line 2—2 of FIG. 3, showing a structure for securing a band to a watch case made in accordance with the present invention.
Figure 3:
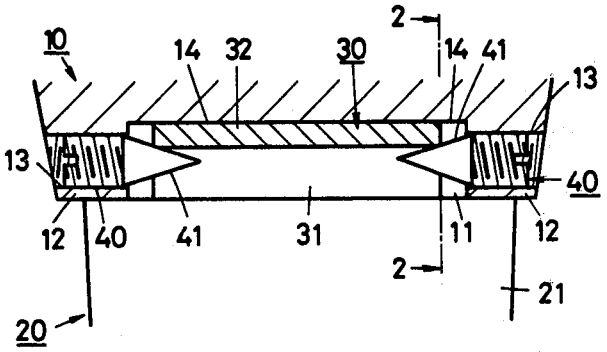
FIG. 3 is a sectional view taken on the line 3—3 of FIG. 2.

Referring to FIGS. 1 to 3, a watch case 10 has a pair of legs 12 projected from one side of the watch case and a cover 11 projected from the side between the legs 12. Each leg 12 has a threaded hole 13. A metal band 20 comprises a band body 21 and a connecting member 30 secured to an end of the band body 21. The connecting member 30 comprises a horizontal plate 31 and a vertical plate 32 downwardly extending from the end of the horizontal plate to form an L-shaped cross section. The end of the horizontal plate 31 is secured to the end of the band body 21 by brazing. A screw 40 for securing the band 20 to the watch case 10 has a taper end portion 41.

The engagement of the band to the watch case will be described hereinafter.

The connecting member 30 is inserted into a space surrounded by the underside of the cover 11, a side wall 14 of the case and legs 12. Then the screws 40 are screwed in threaded holes 13, so that the taper portion 41 of each screw presses the vertical plate 32 against the side wall 14. As the screw 40 is inserted into the threaded hole, the vertical plate 32 is pressed against the side wall 14 with greater force. At the same time, the horizontal plate 31 may be pressed against the underside of the cover 11. Thus, the band is tightly secured to the watch case and the connecting member is prevented from rotation about the screws by the engagement of the horizontal plate 31 with the underside of the cover 11. By loosing the screws 40, the band is detached from the case.

Figure 4:
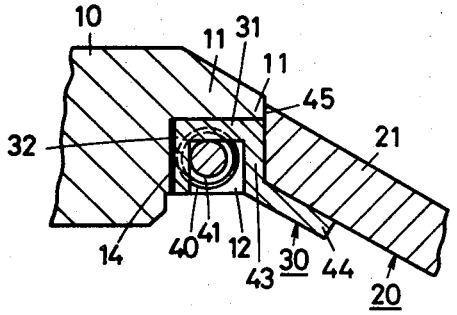
FIG. 4 is a sectional view showing another embodiment of the present invention.

Referring to FIG. 4 showing another embodiment of the present invention, the connecting member 30 has further a second vertical plate 43 and a base plate 44. The connecting member 30 is welded to the band body 21 at the base plate 44. An upper portion 45 of the end wall of the band body 21 is upwardly projected from the horizontal plate 31.

In this structure, the upper portion 45 is pressed against the side walls of legs 12 and cover 11 by screws 40 without gap there-between. On the other hand, there may be formed a gap between the side wall 14 and the vertical plate 32.

In accordance with the present invention, since there is no need to provide an engaging hole in the band and to use the bar having spring loaded pins for engaging with the watch case, an engaging portion of the band may be extremely reduced in thickness and compact in size.

The structure of the present invention is applicable to any metallic band. Therefore, the structure may be easily standardized.

Since rotation of the connecting member about the screws is prevented by the engagement between the connecting member and the side wall of the watch case, no gap is formed between the watch case and the end of the band, which contributes to a good appearance.

What is claimed is:

1. A structure for securing a band to a watch case having a pair of legs and a cover between the legs at a band-connected side, comprising a connecting member secured to an end portion of said band, said connecting member comprising a horizontal plate extending from the end of said band and a vertical plate downwardly extending from the extended end of said horizontal plate, threaded holes provided in said legs, a screw engaged in each of said threaded holes, said screw having a taper end portion which is engaged with said connecting member, whereby said connecting member is pressed against the side wall of said watch case.

2. A structure for securing a band to a watch case according to claim 1 wherein said connecting member has an L-shaped cross section.

3. A structure for securing a band to a watch case according to claim 1 wherein said connecting member further comprising a second vertical plate downwardly extending from the base end of said horizontal plate.

4. A structure for securing a band to a watch case according to claim 3 wherein said connecting member further comprising a base plate extending from the lower end of said second vertical plate, said base plate is secured to the underside of said band.

5. A structure for securing a band to a watch case according to claim 3 wherein the end wall of said band is upwardly projected from said horizontal plate, and the projected portion is engaged with the side wall of said legs and cover.

* * * * *